US006848629B2

(12) United States Patent
Palmer et al.

(10) Patent No.: US 6,848,629 B2
(45) Date of Patent: Feb. 1, 2005

(54) CHILDREN'S WATER TOY

(76) Inventors: Stephen L. Palmer, 4391 Cameron Rd., Cameron Park, CA (US) 95682; William R. Palmer, 3026 Whitetail Dr., Rescue, CA (US) 95672; Norris L. Palmer, 1301 Keeney Way, Sacramento, CA (US) 95864

( * ) Notice: Subject to any disclaimer, the term of this patent is extended or adjusted under 35 U.S.C. 154(b) by 0 days.

(21) Appl. No.: 10/074,481

(22) Filed: Feb. 11, 2002

(65) Prior Publication Data

US 2003/0150938 A1 Aug. 14, 2003

(51) Int. Cl.[7] ..... B05B 17/08

(52) U.S. Cl. ..... 239/17; 239/211; 239/222.17; 446/211; 446/187

(58) Field of Search ..... 239/17, 211, 222.17, 239/381, 383, 505, 506, 222.21; 273/350, 349; 244/12.2, 15, 23; 446/4, 211, 217, 56, 163, 187; D21/173; D23/7, 9

(56) References Cited

U.S. PATENT DOCUMENTS

| | | | | |
|---|---|---|---|---|
| 755,114 A | | 3/1904 | Damm | |
| 1,854,613 A | | 4/1932 | Ishikawa | |
| 2,752,156 A | * | 6/1956 | Washburn | 239/276 |
| 2,785,895 A | * | 3/1957 | Neveling | 239/23 |
| 3,700,172 A | | 10/1972 | Gallegos, Sr. | |
| 4,205,785 A | | 6/1980 | Stanley | |
| 4,274,591 A | | 6/1981 | Sunshine et al. | |
| 4,496,329 A | * | 1/1985 | Kubiatowicz | 446/167 |
| 4,946,164 A | | 8/1990 | Fuller et al. | |
| 5,224,652 A | | 7/1993 | Kessler | |
| 6,161,771 A | | 12/2000 | Henry | |

FOREIGN PATENT DOCUMENTS

| | | |
|---|---|---|
| SU | SU 197455 | 5/1967 |
| WO | WO88/01541 | 3/1988 |

* cited by examiner

*Primary Examiner*—Dinh Q. Nguyen
(74) *Attorney, Agent, or Firm*—Kolisch Hartwell

(57) ABSTRACT

A children's water toy that has a base unit for directing flow of a fluid in a substantially vertical direction and a spraying unit configured to receive fluid from the base member and rebound the fluid to direct it out of the bottom of the spraying unit so that the spraying unit is maintained aloft by the fluid pressure.

6 Claims, 2 Drawing Sheets

CHILDREN'S WATER TOY

FIELD OF THE INVENTION

The present invention relates generally to children's water toys, and more particularly to a water toy that has a base unit that directs a fluid generally vertically upward and a spraying unit that is elevated by the fluid pressure from the fluid directed upward from the base.

BACKGROUND OF THE INVENTION

Children's water toys have long been a source of fun and amusement. In the warmer times of the year, these toys have provided amusement as well as a cooling effect to at the same time. For years, children have turned on a lawn sprinkler and played in the water that the lawn sprinkler discharges. Even spraying each other with the stream put out by a hose shows the fascination children have with water play and water toys. What is needed is a children's water toy that has a portion that is maintained aloft by fluid pressure, to enhance play value and provide an unimpeded area of water for children to dart into and out of.

SUMMARY OF THE INVENTION

The present invention provides an apparatus that maintains aloft a spraying unit of a children's toy using fluid pressure from a base unit. The base portion is configured to connect to a hose for delivery of a fluid to the base unit of the apparatus, and to direct the fluid in a substantially vertically upward direction to the bottom of a spraying unit, thereby maintaining that unit aloft, solely by action of the upwardly directed fluid.

DETAILED DESCRIPTION OF THE INVENTION

Figure 1:
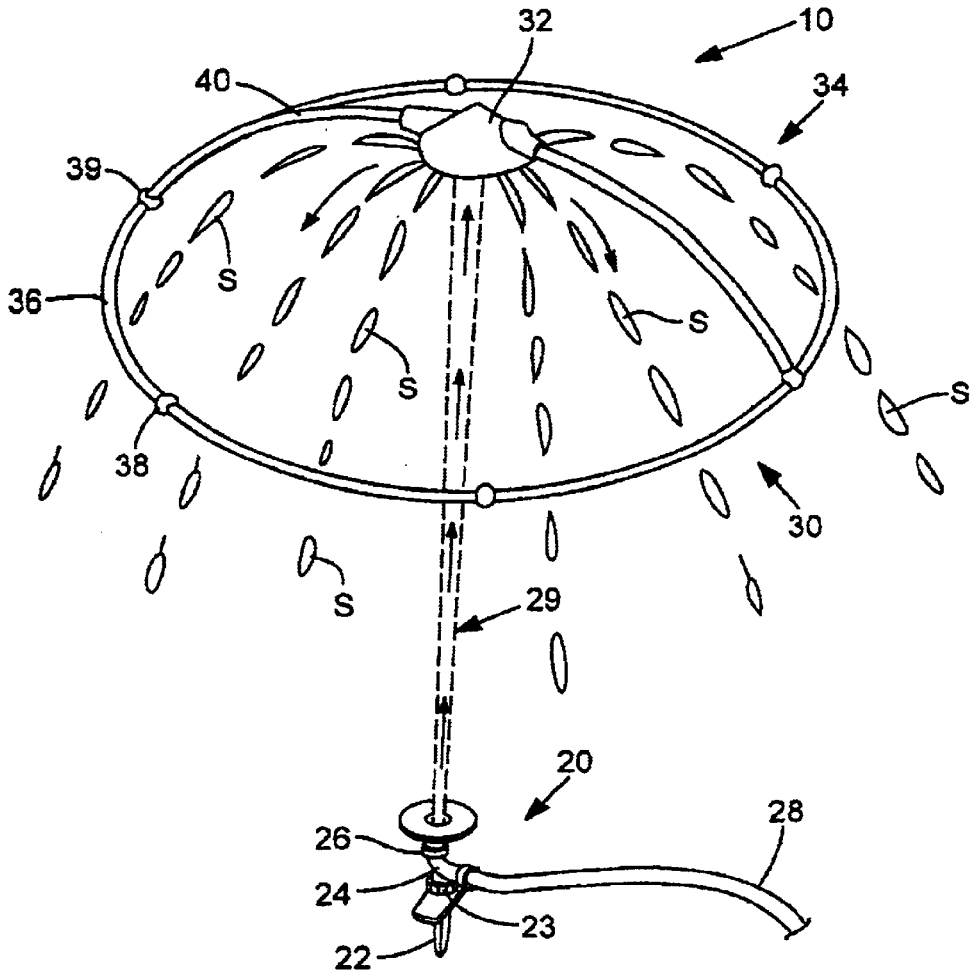
FIG. 1 illustrates an isometric view of one embodiment of the present invention showing the spraying unit being maintained aloft by a fluid after it has passed through the base unit.

The present invention provides a children's water toy in which a spraying unit is maintained aloft by fluid pressure from a base unit. As shown in FIG. 1, a children's water toy 10 in accordance with the present invention includes a base unit 20 and a spraying unit 30.

Base unit 20 has a stake portion 22, a collar 23, an elbow portion 24, and a nozzle portion 26. Stake portion 22 is configured to be easily inserted into a relatively firm area, such as the ground, to secure base unit 20. Securing base unit 20 enables a user to more easily direct the flow of fluid out of base unit 20. Stake portion 22 is connected to elbow portion 24 by collar 23, but may also be connected to nozzle portion 26 or base unit 20 all in one piece. A hose 28 is connected to elbow portion 24, which in turn is configured to connect to nozzle portion 26. Hose 28 supplies a fluid through elbow portion 24, which directs the flow of a fluid to nozzle portion 26. Nozzle portion 26 increases fluid pressure and directs a fluid 29 in a substantially vertically upward direction and out of base unit 20. The height is dependant upon the flow rate from hose 28.

Spraying unit 30 has a fluid-dispensing portion 32, a hoop portion 34 and one or more arcuate transverse portions 40.

Spraying unit 30 receives fluid 29 at initially from the bottom of fluid-deflection portion 32. Fluid 29 is typically water, but may be any other suitable fluid for a child's toy. Fluid 29 then rebounds of the bottom of fluid-deflection portion 32, in a substantially outward and downward pattern toward the children playing with the toy. The fluid pressure maintains aloft spraying unit 30.

An important feature of the present invention is the shape and configuration of fluid-dispensing portion 32, which preferably takes the form of a cone. The cone, with its apex pointed upwardly, and its circular rim facing downwardly, enables fluid directed upwardly from base unit 20 to strike the inside surface of the cone, thereby elevating the entire spraying unit 30, while at the same time providing a rebound surface for the fluid. The fluid rebounds downwardly and outwardly, along the sidewalls of the cone, and provides the outwardly directed spray action such as indicated in FIG. 1 at S. The spray action is a radial dispensing of the fluid, and provides a pleasurable area through which children may dart in and out of during game play. So long as a child does not stand directly above base unit 20, and interfere with the upward direction of the fluid jet or spray, spraying unit 30 will remain aloft, replicating in a sense, a hovering spacecraft.

Hoop portion 34 typically is made up of curved members 36, two-way connectors 38, and three-way connectors 39. Two-way connectors 38 connect two pieces of curved members 36 to form a larger portion of hoop portion 30. Three-way connectors connect two curved portions 36 and one transverse portion 40 together. Curved portions 36 and arcuate transverse portions 40 may be designed to have the same dimensions, thereby reducing tooling and manufacturing costs. It is appreciated that hoop portion 34 may be one continuous hoop or other suitable configuration. Transverse portions 40 are configured to connect to fluid-deflecting portion 32 and three-way connectors 39. As illustrated, fluid-deflecting portion 32 is positioned above hoop portion 34, but could be positioned at different distances thereto. Furthermore, fluid-deflecting portion 32 has connection portions 33 for forming an interference fit with transverse portions 40. It is appreciated that connections portions 33 may be a separate part or any other suitable connections means.

Hoop portion 34 may make spraying unit 30 seem somewhat like a spaceship to the children playing with it. The elevation of spraying unit 30 may be changed by changing the fluid pressure. Thus, a person may interrupt or change flow of fluid 29 to spraying unit 30 to make it seem as though an alien spaceship is moving above them.

Figure 2:
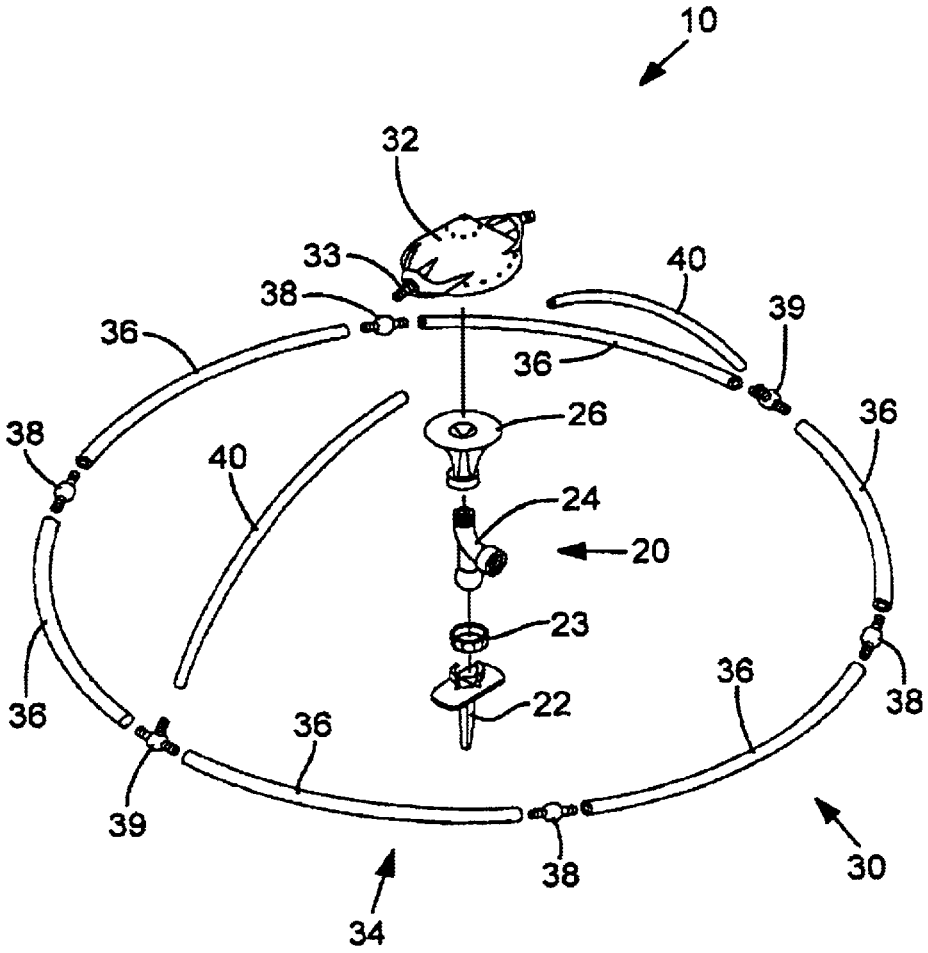
FIG. 2 is an exploded isometric view of the embodiment of the present invention shown in FIG. 1, not to scale.

FIG. 2 shows and exploded isometric view of the children's water toy in FIG. 1, at a slightly larger scale. Base unit 20 has a stake portion 22, a collar 23, an elbow portion 24 and a nozzle portion 26. Stake portion 22 is configured to connect to elbow portion 24 by collar 23, but may also be configured to connect to nozzle portion 26 or base unit 20 may be all one piece or any other suitable configuration.

Spraying unit 30 has a fluid-dispensing portion 32, a hoop portion 34 and one or more transverse portions 40. Hoop portion 34 typically is made up of curved members 36, two-way connectors 38, and three-way connectors 39. Two-way connectors 38 connect two curved members 36 to form a larger portion of hoop portion 30. Three-way connectors connect two curved portions 36 and one transverse portion 40 together. Curved portions 36 and transverse portions 40 may be designed to have the same dimensions, thereby reducing tooling and manufacturing costs. It is appreciated that hoop portion 34 may be one continuous hoop or other suitable configuration. Hoop portion 34 may make spraying unit 30 seem somewhat like an alien spaceship to the children playing with it.

Transverse portions 40 are configured to be connected to fluid-deflecting portion 32 and three-way connectors 39. As illustrated, fluid-deflecting portion 32 is positioned above hoop portion 34, but could be positioned at different distances thereto. Furthermore, fluid-deflecting portion 32 has connection portions 33 for forming an interference fit with transverse portions 40. It is appreciated that connections portions 33 may be a separate part or any other suitable connections means.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements and/or properties may be claimed in this or a related application. Such claims, whether they are directed to a different invention or directed to the same invention, whether different, broader, narrower or equal in scope to any original claims, are also regarded as included within the subject matter of the inventions of the present disclosure.

What is claimed is:

1. A children's water toy comprising:

a base unit mountable on the ground for directing flow of a fluid from a source in a substantially vertical direction;

a fluid-deflection portion configured to receive fluid from the base member and rebound substantially all the fluid to direct it out of the bottom of the fluid-deflection portion unit so that it is maintained aloft by fluid pressure; and a hoop portion positioned beneath the fluid-deflection portion and rigidly connected thereto.

2. The children's water toy claim 1 wherein the base portion further comprises a stake portion, collar portion, elbow portion and nozzle portion.

3. The children's water toy of claim 2 wherein the elbow portion is configured to connect to a hose and to the nozzle portion.

4. The children's water toy of claim 1 wherein the one or more arcuate transfer portions rigidly interconnect the fluid-deflection portion to the hoop portion, fluid-deflecting portion and one or more arcuate transverse portions.

5. The children's water toy of claim 4 wherein the hoop portion further comprises curved members, two-way connectors and three-way connectors.

6. The children's water toy of claim 4 wherein the fluid-deflection portion is a cone.

* * * * *